United States Patent [19]

Plagenhoef

[11] 4,280,700

[45] Jul. 28, 1981

[54] GOLF CLUB AND GOLF CLUB SET

[75] Inventor: Stanley Plagenhoef, Amherst, Mass.

[73] Assignee: Motion Analysis Inc., Amherst, Mass.

[21] Appl. No.: 968,204

[22] Filed: Dec. 11, 1978

[51] Int. Cl.[3] ..... A63B 53/04; A63B 53/12; A63B 53/14

[52] U.S. Cl. ..... 273/77 A; 273/81 A; 273/169

[58] Field of Search ..... 273/77 A, 167 F, 169, 273/170, 171, 172, 81 A, 80 B, 80.2

[56] References Cited

U.S. PATENT DOCUMENTS

| | | | |
|---|---|---|---|
| 1,594,801 | 8/1926 | Stackpole | 273/77 A X |
| 1,696,462 | 12/1928 | Victor | 273/81 A |
| 1,917,774 | 7/1933 | Ogg et al. | 273/167 F |
| 2,231,847 | 2/1941 | Dickson et al. | 273/167 F |
| 2,457,177 | 12/1948 | Reach | 273/80.2 |
| 3,075,768 | 1/1963 | Karns | 273/81 A |
| 3,606,327 | 9/1971 | Gorman | 273/81 A |
| 3,871,649 | 3/1975 | Kilshaw | 273/80 B |
| 4,058,312 | 11/1977 | Stuff et al. | 273/77 A |

FOREIGN PATENT DOCUMENTS

| | | | |
|---|---|---|---|
| 250815 | 4/1926 | United Kingdom | 273/81 A |

*Primary Examiner*—George J. Marlo
*Attorney, Agent, or Firm*—Stuart A. White; Pasquale A. Razzano

[57] ABSTRACT

A set of golf clubs, including both woods an irons, is disclosed in which the various clubs are constructed in their various parameters to aid the user to insure that each and every swing of the club follows the correct path and also to resist rotation of the club head and shaft during impact with the ball about a variety of pivot points on the shaft to assure that the ball will travel in a true flight pattern. The club head is weighted to locate its center of percussion near the toe of the head to reduce rotation of the head at impact about the shaft axis and the handle of the club is weighted to locate the center of percussion of the club below the club head to reduce rotation of the club about the pivot point defined by the base of the index finger of the lower hand in the grip. In addition the shafts of the clubs are stiffened above the club head so that the zone of maximum flexibility of the shaft is about 40 cm above the hosel of the club head whereby the head will be moved forwardly relative to the rest of the club at impact to impart greater force to the ball and distance to the hit. And, the club grip is enlarged to enable the player to apply a greater force to the club resisting rotation of the club shaft in the player's grip.

26 Claims, 16 Drawing Figures

W=30 ± 10 grams
L (pivot point)
G
H
B
F
S

G
B
II
I

W
L
G
H
R
R
S
C
(club's center of perussion)

B
II
I

GOLF CLUB AND GOLF CLUB SET

The present invention relates to golf clubs and, in particular, to new and improved golf clubs which enable a player to achieve greater distance and accuracy in his golf stroke.

Golf clubs of various designs and constructions have been proposed over the years in order to achieve a number of different desired results. However the existing technology for golf club design has not overcome the problems inherent with the mechanics of club heads during impact against the ball. In particular, all golf club heads and their shafts tend, to some extent, to rotate about a number of different axes and in different directions when the club head strikes the ball, with the result that the direction of the ball's flight is adversely affected, as well as the distance over which the ball is driven.

For example, during an impact the club head will tend to rotate away from the ball about the axis defined by the club shaft as a result of torsional forces applied to the club shaft; further rotation in a similar direction can occur because of the physical rotation of the club shaft in the player's grip about the axis of the shaft. Rotation of the club head in this direction at impact will materially affect both the distance and accuracy of the golf shot. In addition further rotation of the club head away from the ball at impact can occur about the pivot axis on the club shaft defined by the lowest finger in the player's grip, reducing the force applied to the ball and thus reducing the distance it will travel. These and other characteristics of club head mechanics at impact have not been adequately dealt with, or not dealt with at all, in previously proposed golf club constructions.

Accordingly it is an object of the present invention to provide an improved set of golf clubs which overcomes these problems.

Another object of the present invention is to provide an improved set of golf clubs which achieve more consistent straight and long drives.

A further object of this invention is to obtain forward movement of the club head relative to the shaft during impact with the ball to allow a player to achieve greater distance.

A still further object of this invention is to reduce the tendency of golf club heads to rotate or twist relative to the shaft axis, and about the player's grip, to permit greater distance and accuracy in golf shots.

The above, and other objects, features and advantages of the invention will be apparent from the following detailed description of an illustrative embodiment thereof, which is to be read in connection with the accompanying drawings, wherein.

Figures 1, 2, 4, 5:
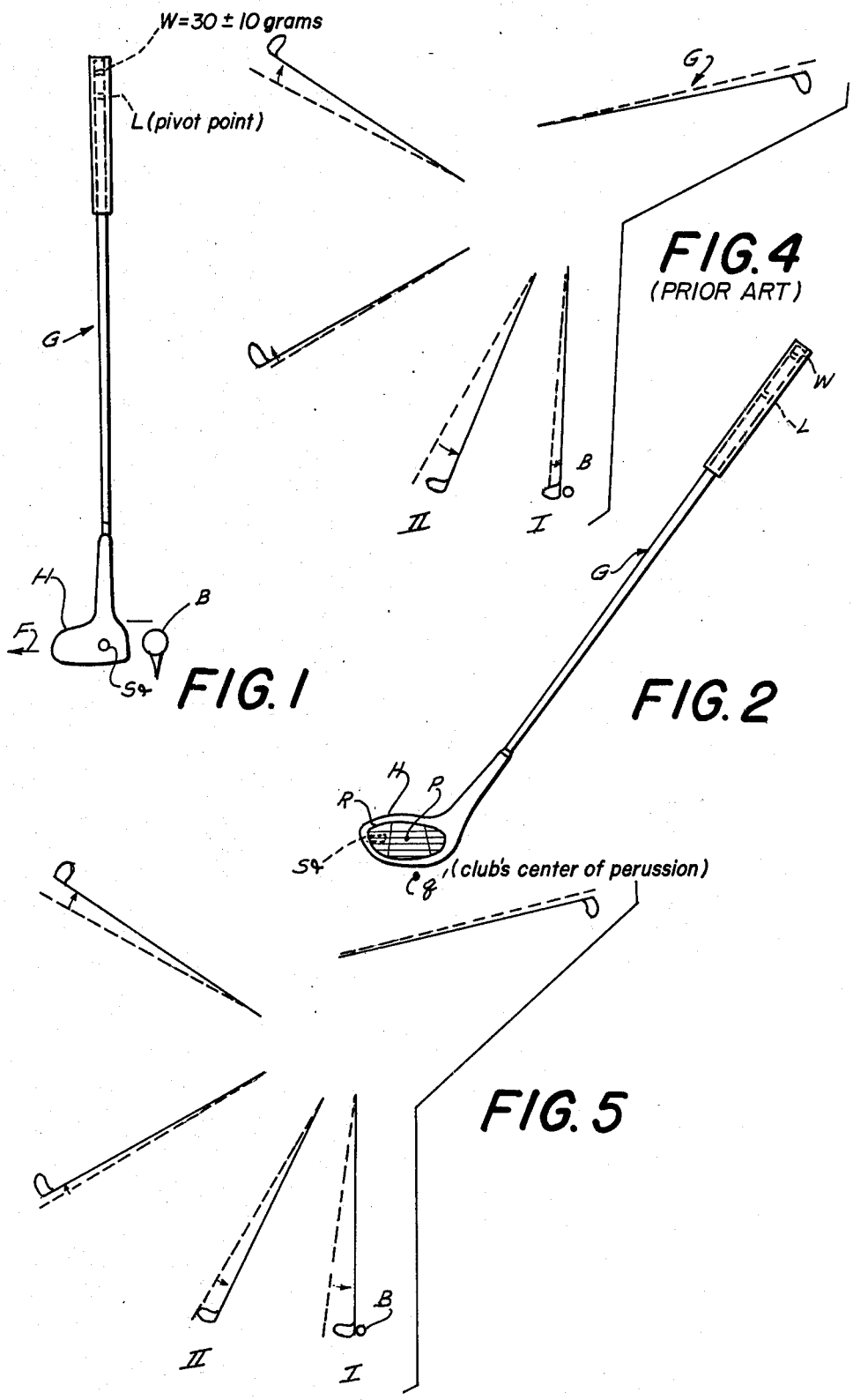
FIG. 4 (PRIOR ART)
FIG. 1 is a side vertical elevational view of a golf club incorporating the principles of this invention.
FIG. 2 is a front vertical elevational view of the golf club shown in FIG. 1.
FIG. 4 is a sequence view showing the relative configuration of a conventional golf club and shaft at different portions in a golf swing.
FIG. 5 is a sequence view similar to FIG. 4 of a golf club constructed in accordance with the present invention at different positions in a golf swing.
Figure 3:
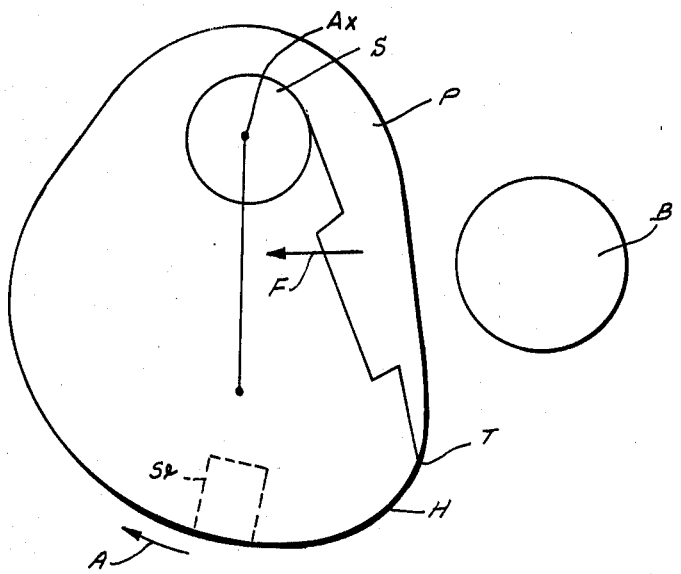
FIG. 3 is a plan view of the club head shown on the club of FIG. 1.

The problems to which the present invention is directed can best be appreciated with reference to FIGS. 1–3 which illustrate a golf club G constructed in accordance with the present invention. When a golf club, whether of conventional construction or the construction according to this invention, strikes a golf ball B, a force F, will be imparted to the head H of the club G which will tend to rotate the club head backwards (i.e. away from the direction of the swing) about the longitudinal axis $A_x$ of the shaft. Thus, as seen in FIG. 3, the club head will tend to rotate clockwise in the direction of arrow A about the longitudinal axis of the club shaft S. And, the further from the shaft that the ball hits the club head face (i.e. the closer to the toe T of the club head) the greater will be the tendency of the club head to rotate about this axis. This tendency is overcome by the moment of inertia ($I_o$) of the club head about the shaft.

The moment of inertia of the club head is determined by equation:

$$I_o = t^2 wr/4\pi 2 \qquad (1)$$

where t equals the time of a full cycle of rotation of the club head about the pivot point, w equals the weight of the head in grams and r equals the distance from the pivot point to the center gravity of the club head in centimeters. The pivot point referred to is the point about which rotation of the head will take place, i.e. the point at which the head is fixed, in this case the longitudinal axis of the club shaft.

The moment of inertia of the club head can be increased to resist this rotation by changing anyone of the parameters t, w or r. In accordance with one aspect of this invention I have found that it is most efficient to increase the parameter r by adding weight, such as for example a lead slug Sl, to the toe of the club head. The lead slug can be inserted in a recess R formed in the club toe in any convenient manner, such as for example by a press or friction fit. Alternatively, the club head is formed of a material having uniform density and is shaped so that the heel is narrower than the toe. With irons this can be done during the casting process.

In accordance with the present invention the tendency of the club head to rotate backwards about the axis of the shaft is further reduced by two further changes in the club structure which I have developed. These specifically relate to accurate location of the center of percussion of the club head and the entire club itself.

The center of percussion is a point at which a free standing body can be struck so that the only motion imparted to the body is rotational motion around the body's pivot point. Thus, for example, if the club head H shown in FIG. 2 where anchored at the longitudinal axis of the club shaft, then if the club face strikes a ball at or beyond the center of percussion (identified by the point P in FIG. 2) in the direction towards the toe than a greater proportion of the imparted force will be translated into rotational motion of the head about axis $A_x$ than if it were struck inside the center of percussion. In the latter case most of the force of the impact would be translated into linear motion directed away from the source of impact. Accordingly I have found that it is desirable to place the center of percussion of the club head further towards the toe than is presently done. This results in the club head rotation about the shaft axis being less than it would be if the center of percussion were closer to the shaft, as in previously proposed golf clubs.

The center of percussion of the club head is determined with the use of the formula for moment of inertia (equation 1 above) and two additional formulas:

$$k^2 = I/m \quad (2)$$

where k is the radius of gyration of the club head and m is the mass of the club head in gms/sec$^2$; and $$q = k^2/r \quad (3)$$

where q is the center of percussion located at a distance in centimeters from the shaft axis.

I have found that by weighting the toe of the club head and by reducing weight in the heel of the club head, the center of gravity (r) of the head is moved away from the center of the club head, further than is the practice today with available clubs. This, in turn, moves the center of percussion beyond the center of the club head to a point near the club toe. As described above, this placement decreases the rotation of the club head about the shaft at impact.

I have also found that rotation of the club head about the shaft axis at impact can be further resisted by providing an enlarged grip on the club. At present the standard club grip is seven cm in diameter and the largest grip is seven and three tenths (7.3) cm in diameter. By using an even larger grip a greater amount of force can be applied by the golfer at the grip to counter the backward rotation of the club head that is transmitted to the grip by the shaft. The amount of the resultant force which can be applied is determined by the formula:

$$F_I \times d = F_s \times r \quad (4)$$

where $F_I$ equals the force at impact, d equals the distance from the point of impact to the shaft axis, $F_s$ equals the force applied by the golfer at the grip and r is the radius of the grip.

The concept of adjusting the location of the center of percussion also has application to reducing another type of impact rotation in the golf club. When a ball is hit, the impact produces a rearward force on the club head that not only tends to cause the head to rotate, as described above, but also tends to cause the entire club to rotate in the plane of the swing, rearwardly away from the ball about a pivot axis which extends generally parallel to the ground and is defined by the lower extremity of the golfer's hands; typically the index finger of the lower hand in the golfer's grip. However, it is more difficult to resist this type of rotation in both the golfer's hands than it is to resist linear motion of the club away from the point of impact. And, as described above, when a body is struck inside its center of percussion there is less rotation about its pivot point and more linear motion directly away from the point of impact.

In accordance with the present invention, the club is designed and weighted to place the center of percussion q' of the club below the club head (see FIG. 2) thereby to increase the more readily resistable linear motion of the club at impact and decrease the rotational motion. This enables the golfer to retain a firm grip at the time of impact and thus increase the force with which the ball is struck. In accordance with one embodiment of the invention, this is done by placing a weight w, in the form of a lead slug, weighing 30 grams (±10 grams) at the end of the club handle above the top of the shaft (see FIGS. 1 and 2). This weight can be a metal slug in an enclosure secured, by gluing or the like, to the top of the shaft and shaped to prevent the golfer from using it as a grip.

The center of percussion is located below the club head when this weight is added because the result of the increased weight in this location is an increase in the parameter t of formula (1) above. The effect of the increased t outweighs the effect in the reduced r in the formula (since the center of gravity is moved up closer to the top of the shaft and the club pivot point defined by the grip), and it follows from formulas (1), (2) and (3) that the center of percussion for the club will be below the club head.

Table I below sets forth the relevant parameters for a series of prior art clubs identified by the tradenames and a club according to my invention (Plagenhoef). Each club compared is a driver from a commercially available set. It is easily determined that the club according to this invention is the only one to achieve this striking result.

TABLE I

| Club | cm. Length | r(cm. grip to C.G.) | q(cm.pivot pt 0 to C.P.) | distance from top of shaft to center of percussion in % |
|---|---|---|---|---|
| Manufacturer A | 109.1 | 79.1 | 81.83 | 92% |
| Manufacturer B | 114.5 | 77 | 93.89 | 99% |
| Plagenhoef | 111.3 | 77.4 | 95.5 | 105% |

Previously proposed golf clubs do not propose or suggest this location of the center of percussion below the club head. While the center of percussion has been lowered into the club head by adding weights to the bottom of the club head (thus increasing "r" while decreasing "t"), this made the club head (swing weight) too heavy for satisfactory play.

Since the location of the pivot point on the club, i.e. the lowermost finger in the golfer's grip, will have an effect on the location of the center of percussion it is desirable to mark the grip with an indicia, such as a colored line L, at the desired pivot point 20 cm below the top of the shaft. This allows the golfer to place his hands so that the pivot point of the club at impact is always the same for each shot and so that the center of percussion of the club remains below the club head.

Another type of rotation which is a problem in golf swings at impact occurs when the golf ball is struck near the heel of the club and the force of that impact tends to move the club head linearly away from the point of impact. Because the club head is attached to the shaft it can move in this manner only by bending the shaft away from the direction of the swing at the point of maximum flexibility about the hosel. This movement is in addition to rotational movement about the player's index finger, or lower finger in his grip, described above.

The prior art attempted to solve this problem in two different ways, neither of which was satisfactory, because while solving this problem, it increased the severity of others. One method was placing weights in the heel of the club; however this solution makes it impossible to secure proper placement of the center of percussion of the club head near the head's toe and this increases the effects of head rotation about the club shaft. The second solution, stiffening the shaft immediately about the hosel, is disclosed in the prior art.

The present invention considerably solves these problems by significantly raising the point of maximum flexibility and increasing stiffness of the shaft above the hosel by an amount not disclosed in the prior art and for a distance not disclosed in the prior art. Table II indicates the stiffness of a variety of prior art clubs as well as a club according to the present invention at points 20, 40, 60 and 80 cm above the hosel (as shown in FIGS. 13*a–d*) measured in cms off the horizontal when a 30 pound weight is applied to the shaft with the support points being 40 cm apart, equidistant from the point of suspension of the 30 pound weight.

TABLE II

| Club | Flex at 20 cm | 40 cm | 60 cm | 80 cm |
|---|---|---|---|---|
| Manufacturer A | 1.1 | 1.0 | .8 | .5 |
| Manufacturer B | 1.1 | .5 | .3 | .2 |
| Plagenhoef | .3 | .3 | .6 | .2 |

Referring to FIGS. 4 and 5 it can be seen how the present invention resolves the problem of improper shaft harmonics. As seen in FIG. 4 a golf club of the prior art construction is shown at several different points in a swing (in solid lines). In each location a dotted line represents the position of the shaft if it were completely rigid and extended straight from the player's grip. Since the shaft is not completely rigid different parts of it move forward at different rates of speed, as shown by the solid lines representing the actual position of the club head during the swing. The solid line for the shaft is shown straight for convenience in showing the relationship of the club head to the dotted line.

High speed motion pictures reveal that at point I in FIG. 4 the prior art club is in a position such that the maximum force is not applied to the ball at impact. This is because the club head is moving backward relative to the rest of the shaft. (Note that the head is closer to the dotted lines at point I than at point II, indicating that head speed is slowing down relative to the rest of the shaft). This occurs because the point of maximum flexibility of a prior art shaft is some 5 to 20 cm above the hosel. The location of the point of maximum flexibility of prior art clubs, as compared to these of the present invention, is set forth in Table III below. This test is done by locking the grip in place and suspending a 10 pound weight from the head.

TABLE III

| Club | Point of Max. Flexibility in cm from Top of Hosel |
|---|---|
| Manufacturer A | 20 |
| Manufacturer B | 20 |
| Manufacturer C | 20 |
| Plagenhoef | 50 |

I have discovered that placing the point of maximum flexibility of the shaft at least 40 cm above the top of the hosel of the club head changes the harmonics of the shaft during the swing as illustrated in FIG. 5. Again the dotted lines indicate the position of the shaft if it were absolutely rigid and the solid lines that of the actual shaft. Now it can be seen at point I that the club head is moving forward (faster) than the remainder of the shaft at the moment of impact. The head is moving further ahead of the dotted line and is further from that line than it was earlier in the swing, i.e. point II.

High speed motion pictures confirm the above and also confirm the fact that a club built according to the teachings of the prior art will not have proper harmonics because the point of maximum flexibility is too close to the hosel.

The shaft design of the present invention, incorporating these previously described features and parameters have been incorporated in an integral structure such that all the elements of the golf club work together and the club is held stable during the swing and at impact.

Figure 6:
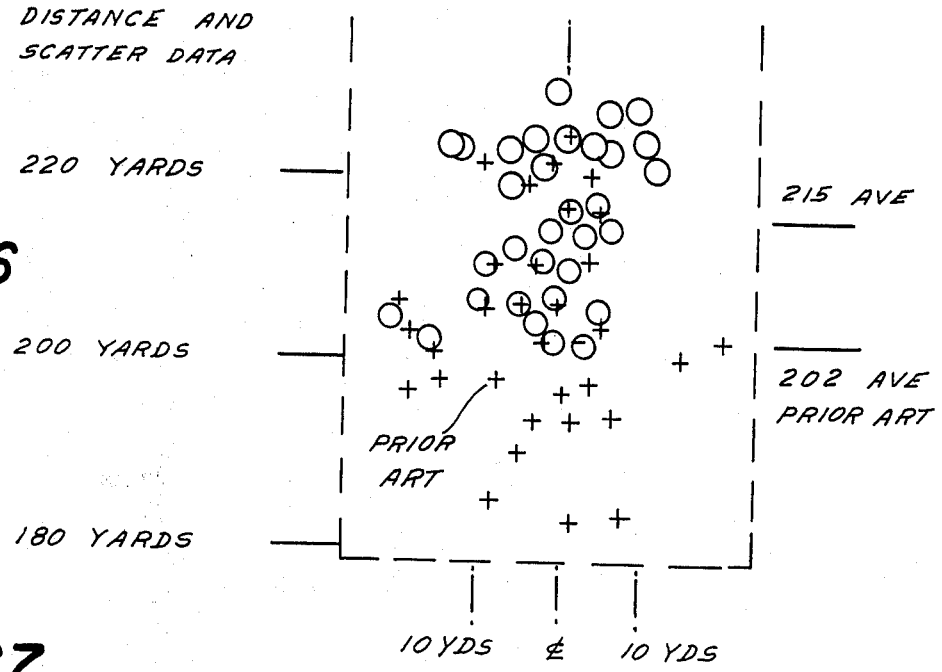
FIG. 6 is a diagram comparing the results of distance and accuracy tests achieved by the same golfer using golf clubs of conventional construction and golf clubs constructed in accordance with the present invention.

With the construction of the golf clubs of the present invention, it has been found that more consistently long and straight golf hits can be achieved. FIG. 6 represents a graph showing the distance and scatter data of a number of golf balls hit by the same golf professional using golf clubs constructed in accordance with the present invention (represented by the circles) and a commercially available golf club driver, sold under the Ben Hogan tradename.

The chart of FIG. 6 shows that the thirty two balls hit with a driver constructed in accordance with the present invention had an average travel distance of 215 yards, while the thirty two hit with the prior art driver (under the same conditions and using the same kind of ball) had an average distance of 202 yards (these are represented by the crosses in the chart). In addition, as seen from the array of indicia on the chart, the vast majority of golf balls hit with the golf club of the present invention were within a range of ten yards on either side of the center line, whereas a far greater number of golf balls hit with the prior art club were outside of that range.

Figure 7:
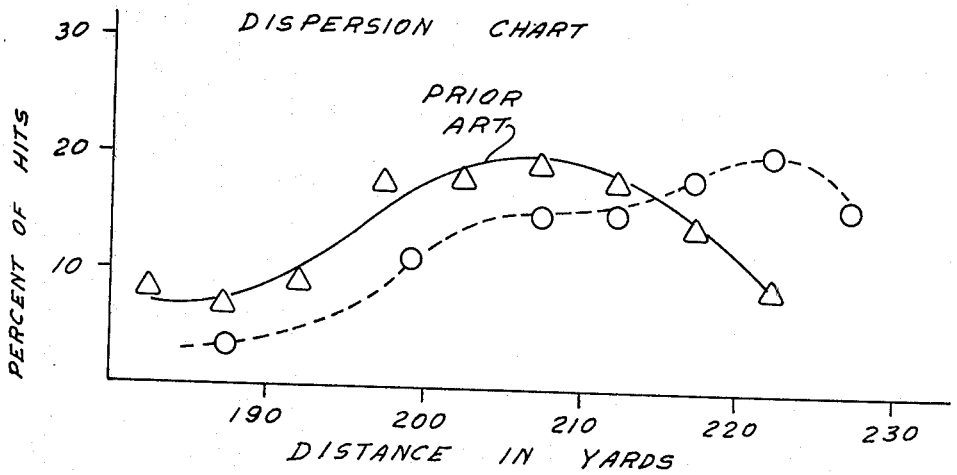
FIG. 7 is a dispersion chart showing the percentage of hits against distance for the prior art clubs and the clubs of the present invention.

FIG. 7 is a dispersion chart of the golf shots represented in FIG. 6, which compares the percentage of hits over a particular distance with the present golf driver as compared to the prior art driver. As seen therein, the driver of this invention had a far greater percentage in the higher distance ranges.

In accordance with the present invention, these more uniform distance and accuracy results are achieved by arranging the parameters of the golf club shaft and head to insure that each and every swing of any particular club follows the correct path and that the club head strikes the ball at the right time in the swing, at the right angle, and with reduced rotation about the club shaft and the player's grip during impact. In addition, the clubs are formed to be substantially uniform, from one club to another, so that a player need make only a few adjustments to a swing depending upon the club which is chosen.

Figure 8:
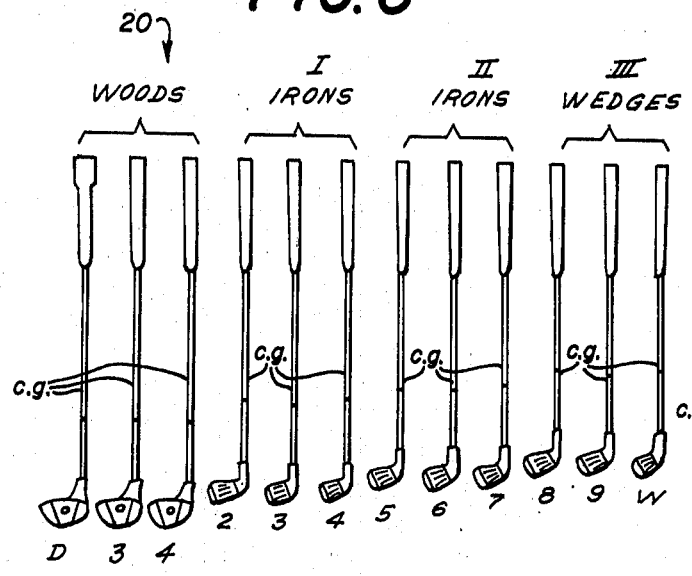
FIG. 8 is a plan view showing a set of golf clubs constructed in accordance with the present invention.

A golf club set 20 constructed according to the present invention is illustrated in FIG. 8 in the drawing. As seen therein, the set includes a plurality of woods (three in the illustrative embodiment) as well as a plurality of irons. The various clubs are labeled with a legend number immediately therebelow (D standing for "driver").

As seen in FIG. 8 all of the woods of the golf club set of the present invention have the same shaft length, selected to be 43 inches. They are also designed so that each club has the same center of gravity and center of percussion, with each club head also having the same center of gravity and center of percussion.

The club heads for the woods are all formed to be of substantially the same external size and weight, preferably that of a conventional three wood, except that the club face slope of course varies depending upon the wood type. That is, the club face slope for the driver will be 10°; the three wood; 15°; the four wood; 18° and the five wood; 20°. All of the woods will have a lie of 54°. However, the driver may have a somewhat greater head size but not weight than the 3, 4, or 5 woods.

Figure 9:
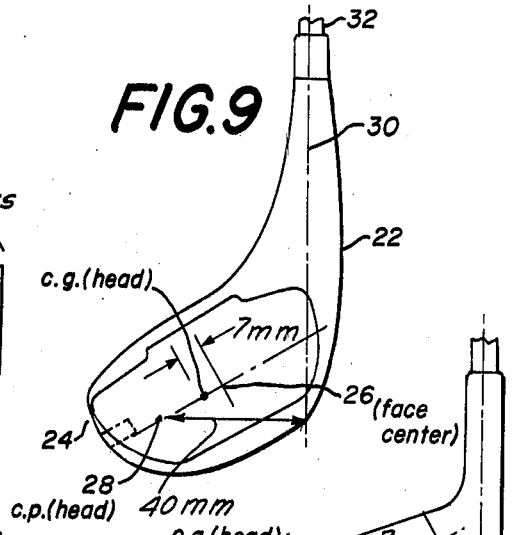
FIG. 9 is a side elevational view illustrating a wood club head of the present invention.
Figure 10:
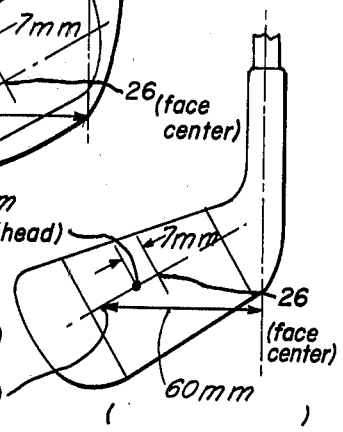
FIG. 10 is a side view similar to FIG. 9 of an iron club head constructed in accordance with the present invention.
Figure 11:
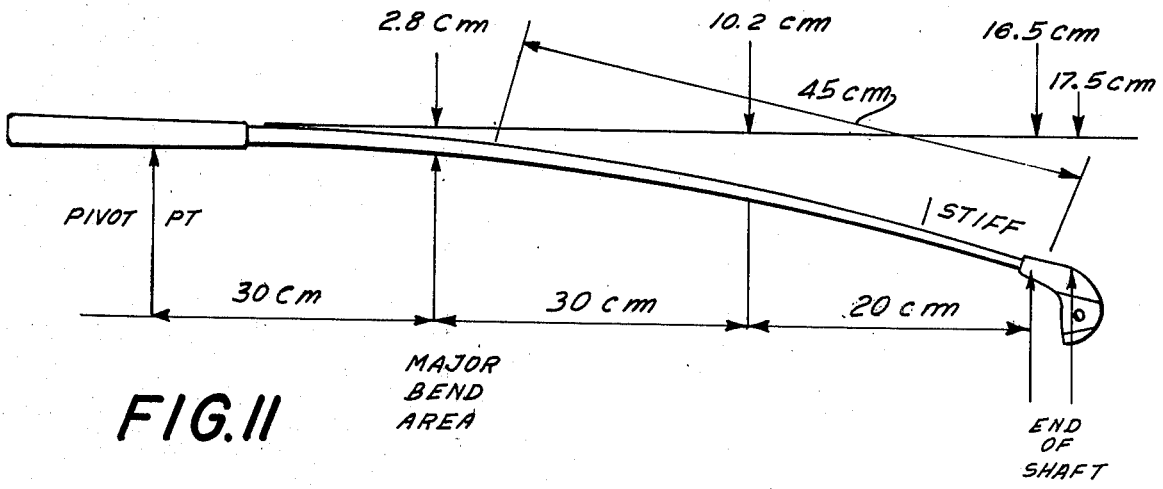
FIG. 11 is a side view showing the flexure characteristics of a golf wood constructed in accordance with the present invention.

Alternatively, it is contemplated that the heads can be made of conventional sizes with their weights adjusted in any convenient manner so that their weight is equal to the larger size head. The weight of the club head for the woods (FIG. 9) is distributed such that the center of gravity (c.g.) of the head 22 is located 7 mm (±2 mm) towards the toe 24 of the head, as illustrated in FIG. 10, from the club face center 26. This location of the center of gravity produces a center of percussion 28 forty mm (±2 mm) from the axis 30 passing through the center of the shaft 32 of the club. This dimension can be found using the mathematical formulas discussed above in detail. In this manner, the center of gravity and center of percussion of each head is exactly the same and located in the desired positions according to the present invention, so that the player does not have to very his swing.

For the entire club, the balance point (or c.g.) is along the shaft 32 of the club (FIG. 8), about 70% of the shaft length from the end 33 of the handle 34 of the club. In this regard, the presently preferred total club weight is 380 grams ±5 grams. However, as described above, it is preferable to adjust the center of gravity of the entire club so that it is closer to the handle, with the result that the center of percussion of the club is actually below the head. This is achieved in the woods by placing an additional 30 gram weight (+10 grams) in the end 33 of the handle 34 in any convenient manner at a location above the shaft end and at the end of the handle.

In addition, as described above, the grip diameter is increased to 3 inches ±¼ inch (i.e. 7.5 cm ±0.6 cm) at a point 6 inches from the end of the grip, as opposed to the normal 2¾ inches ±⅛ inch (i.e. 7 cm ±0.3 cm) to aid the golfer in resisting torque transmitted from the club head to the shaft. Still further, the present pivot point for the club, defined by the index finger of the lower hand in the grip can be marked to control location of the club's center of percussion, as described above.

Figure 12:
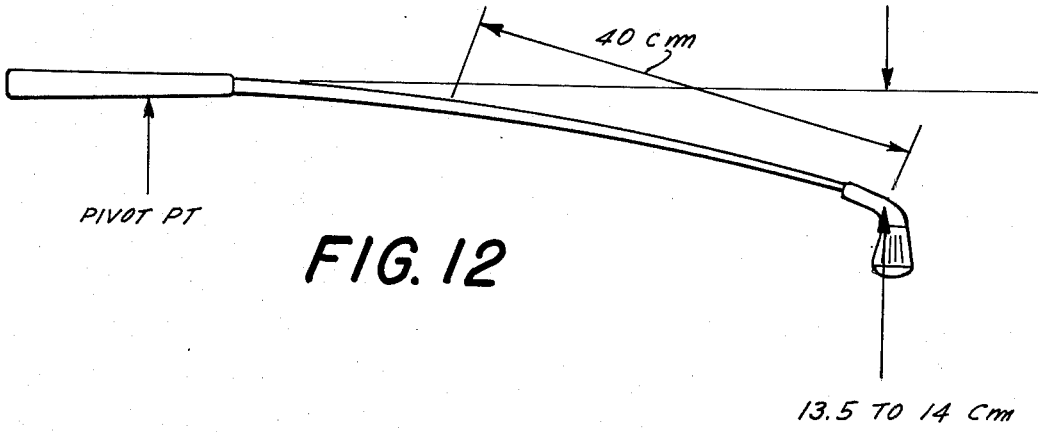
FIG. 12 is a side view similar to FIG. 11 showing flexure characteristics of a golf iron constructed in accordance with the present invention.
Figure 13A:
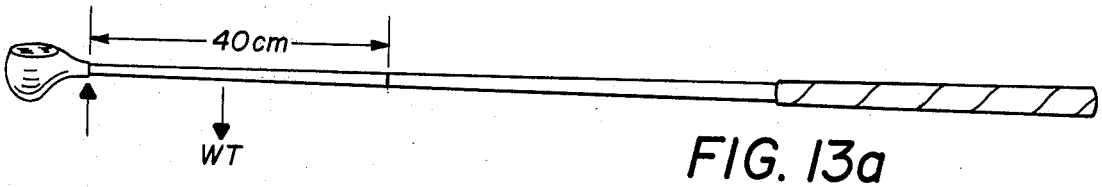
FIG. 13*a*–13*d* are schematic side views showing a method of measuring golf club shaft stiffness.
Figure 13B:
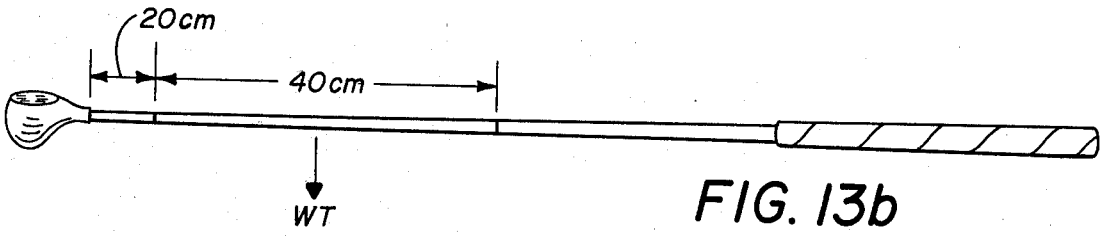
Figure 13C:
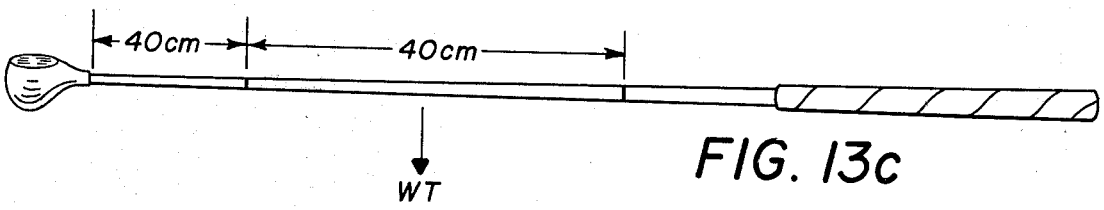
Figure 13D:
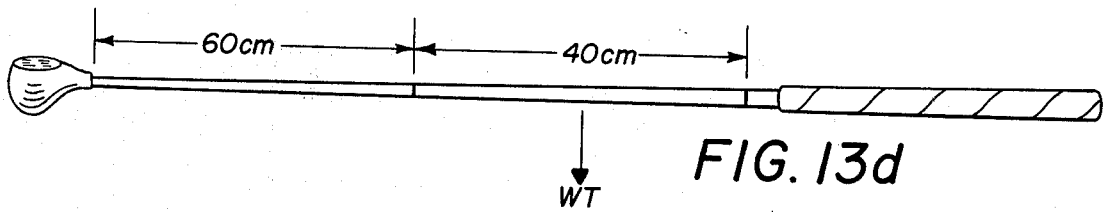

Finally, the wood shafts are specially designed so that they are as stiff as possible for a distance of approximately 20 cm above the club head. The major flex point of the shaft is designed to begin 40 to 45 cm above the head and to occur over the next 12 cm length of the shaft. By this arrangement, and with the pivot point of the club shaft against the player's hands during the swing being located 20 cm from the end of the handle, and with a 10 pound weight applied to the end of the shaft (see FIG. 12), the shaft will have a total flex of no more than 17 to 18 cm, for all woods. I have found that this flex, along with the other balance characteristics of the wood, provide the improved driving and accuracy results described above. The flexibility of the club shaft can be controlled in any convenient manner, for example with a graphite shaft structure flexibility may be controlled by varying the alignment of the graphite fillers at the point of maximum flexibility.

Alternatively, it has been found that the same results can be achieved with a set of woods whose shaft has a flex point located between 40 and 52 cm above the head or between 52 and 64 cm above the head. These different flex points are selected for players with varying types of swings. This choice of shaft flex will be determined by the swing pattern and selected bio-mechanical measurements will determine the flex for a particular individual.

The irons of the golf club set of the present invention are divided into at least three groups or sets, as illustrated in FIG. 8. As seen therein, the first Set I includes the irons 2, 3, 4; the Second Set II includes the irons 5, 6, 7; and the third Set III includes the irons 8 and 9 and the wedge W. The irons in each group or set have the identical measurements except for club face slope. Preferably, the irons in Set I weigh 415 grams ±7 grams; the irons in Set II weigh 435 grams±7 grams; and the irons in Set III weigh 450 grams +7 grams. These weights do not include the added grip end weight. The club face slope for the various irons is conventional and the lie for the irons is selected as follows:

Set I: 57°
Set II: 60°
Set III: 63°

The bottoms of the irons are formed to be flat and wide, and the irons in Set I have a width of ½ inch; the irons in Set II have a width of 5/16 inch; and the irons in Set III have a width of ¾ inch, at the midpoint of the club head.

As with the wood heads, the weight of the iron heads is distributed such that the balance point or center of gravity thereof is located 7 mm (±2 mm) towards the toe from the club face center 26 which results in the location of the center of percussion of the iron being a distance of 60 mm (±2 mm) from the axis 32 of the shaft. The distribution of the weight in the irons as well as the woods has the center of mass towards the toe.

Preferably, the shaft lengths of the irons are selected as follows:

Set I: 39½ inches
Set II: 37½ inches
Set III: 35½ inches.

The shaft length, club head weight, and handle for the clubs are selected such that the balance point for Set I irons is 74% of the club length from the end of the handle; the balance point for Set II irons is 76% of the club length from the handle end; and Set III irons is 78% of the club length from the handle end. However, as with the woods, it is preferable that the center of gravity of the entire club head be moved closer to the handle and that the center of percussion be moved below the head. This is achieved by weighting the handle end of the club, by inserting a weight in the club as described above according to the following weight selection:

Set I: 27 grams ±7 grams

Set II: 23 grams ±5 grams
Set III: 20 grams ±4 grams.

In this regard, as with the wood handles, the handles of the irons taper at the end of the grip in a very pronounced manner outwardly in order to accommodate the end weight. The shaft length is measured from below the weight, thus making the grip start below the taper. The remainder of the grip below the taper is of normal taper and construction, with the circumference of the grip 6 inches from the shaft and being about 3 inches.

The shafts for the irons are designed to follow a predetermined flex pattern, for the same reasons discussed above with respect to the wood shafts. Specifically, the irons are provided with a very stiff zone in the shaft directly above the club head and a flex area or zone of maximum flexibility further up the club shaft. Specifically, Set I irons have a zone of minimum flexibility or maximum stiffness for a distance of 11 cm above the club head, with the zone of maximum flexibility located between 40 and 50 cm above the club head; Set II irons have a zone of maximum stiffness 10 cm above the club head with a zone of maximum flexibility between 38 and 48 cm above the club head; while the Set III irons have a zone of maximum stiffness of 9 cm above the club head with a zone of maximum flexibility of between 36 and 46 cm.

With this flex pattern, and with the pivot on the handle being 20 cm from the end of the handle, as illustrated in FIG. 13, the flex pattern (i.e. the amount of deflection of the club head from the axle of the shaft) for the irons with a 10 pound weight applied to the end of the shaft will be as follows:

Set I: 13.5 cm to 14 cm
Set II: 12 cm to 12.5 cm
Set III: 9.5 cm to 10 cm.

By arranging the parameters of the various golf clubs in the golf set in the present invention, a uniform swing pattern is achieved which produces improved results as compared with prior art devices. The uniformity of the respective clubs requires a minimum of accommodation by the player during use, which also aids in achieving greater accuracy. The specific flexual pattern for the shaft of the clubs, as well as the location of the center of gravity of the club head and the center of percussion thereof all cooperate to insure that the club head and shaft do not twist under impact, to avoid deleterious effects to the drive of the ball.

A table showing the important parameters of the golf set appears as follows:

TABLE I

| | Length | Lie | Club Weight | Handleway | Flexpoint above head |
|---|---|---|---|---|---|
| Woods | 43 | 54° | 380 gm. ± 10 gms. | 30 gms. ± 10 gms. | 40–45 cms. |
| Irons | | | | | |
| Set I (2,3,4) | .39½ | 57° | 415 gms. ± 7 gms. | 27 gms. ± 7 gms. | 40–50 cms. |
| Set II (5,6,7) | 37½ | 60° | 435 gms. ± 7 gms. | 23 gms. ± 5 gms. | 38–48 cms. |
| Set III (8,9,10) | 35½ | 63° | 450 gms. ± 7 gms. | 20 gms. ± 4 gms. | 36–46 cms. |

Although an illustrative embodiment of the present invention has been described herein with reference to the accompanying drawings, it is to be understood that the invention is not limited to that precise embodiment, and that various changes and modifications may be effected therein by one skilled in the art without departing from the scope or spirit of this invention.

What is claimed is:

1. A golf club comprising a club head and shaft, said club head being weighted to locate its center of gravity toward the toe 7 mm (±2 mm) from the club face center and the club head center of percussion between the toe and center of gravity 40–60 mm (±2 mm) from the longitudinal axis of said shaft.

2. A golf club as defined in claim 1 wherein said club is weighted to locate the center of percussion of the club below the club head.

3. A golf club as defined in claim 2 wherein said shaft has a zone of maximum flexibility located at a point at least 40 cm from the club head.

4. A golf club comprising a club head and a shaft, said club being weighted to locate the center of percussion of the club below the club head; said shaft having a zone of maximum flexibility located at a point at least 40 cm from the club head.

5. A golf club as defined in either of claims 2 or 4 wherein said club includes a grip and a 30 gram (+ or −10 grams) weight placed at the end of the grip to weight the club and locate the center of percussion thereof below the club head.

6. A set of golf clubs each having a shaft and a club head, each of said club heads having a club face center and being weighted to locate its center of gravity 7 mm (±2 mm) toward the toe of the club from said club face center, with the center of percussion of the club head located at the club face at least 36 mm (±2 mm) from the longitudinal axis of the shaft; said clubs each including a grip and a 30 gm (±10 gm) weight placed at the end of the grip to weight the club and locate the center of percussion thereof below the club head.

7. A set of golf clubs as defined in claim 6 wherein said shafts each include a handle and a 30 gram weight (±10 grams) placed at the end of the handle.

8. A set of golf clubs as defined in claim 7 wherein said club heads comprise golf woods and each of said club heads has substantially the same external size and weight.

9. A set of golf clubs as defined in claim 8 wherein each of said wood heads weighs 380 ±10 grams.

10. A set of golf clubs as defined in claim 9 wherein each of said clubs has a finished shaft length of approximately 43 inches.

11. A set of golf clubs as defined in claim 8 wherein said shafts each have a zone of maximum stiffness over the 20 cm thereof directly above the head and a zone of maximum flexibility having a length of approximately 12 cm and commencing at a point located between 40 and 64 cm from the head such that the total deflection of the club head from the axis of the shaft when subjected to a 10 pound force will be between 17 and 20 cm for each of the woods.

12. A set of golf clubs as defined in claim 6 wherein said club heads comprise golf irons with the center of percussion thereof located at the club face approximately 60 mm (±2 mm) from the axis passing through the center of the shaft.

13. A set of golf clubs as defined in claim 12 wherein said set includes 2, 3, 4, 5, 6, 7, 8, 9, and 10 irons with said irons defining three groups of irons respectively consisting of Set I, including the 2, 3 and 4 irons; Set II including the 5, 6 and 7 irons; and Set III including the 8, 9 and 10 irons; with the irons in each set having the same shaft length.

14. A set of golf clubs as defined in claim 13 wherein the club heads in each set have the identical external measurements, except for club face slope, and the same weight.

15. A set of golf clubs as defined in claim 13 wherein the irons in Set I weigh 451 grams ±7 grams; the irons in Set II weigh 435 grams ±7 grams; the irons in Set III weigh 450 gram ±7 grams.

16. A set of golf clubs as defined in claim 13 wherein said shafts each include a handle and a weight placed in the end of the handles.

17. A set of golf clubs as defined in claim 16 wherein the weights added to said handles are as follows:
Set I: 27 grams ±4 grams
Set II: 23 grams ±5 grams
Set III: 20 grams ±4 grams.

18. A set of golf clubs as defined in claim 13 wherein said irons have shaft lengths selected as follows:
Set I: 39½ inches
Set II: 37½ inches
Set III: 35½ inches.

19. A set of golf clubs as defined in claim 13 wherein said shafts in each set have a zone of maximum stiffness having a length directly above the head as follows:
Set I: 11 cm
Set II: 10 cm
Set III: 9 cm;
and a zone of maximum flexibility located above the shaft head as follows:
Set I: 40 to 50 cm
Set II: 38 to 48 cm
Set III: 36 to 46 cm
such that the total deflection of the club head from the axis of the shaft when subjected to a 10 pound force will be as follows:
Set I: 14 to 13.5 cm
Set II: 12.5 to 12 cm
Set III: 10 to 9.5 cm.

20. A set of golf clubs as defined in claim 13 wherein the balance points of the irons is located from the end of the club handle at distances as follows:
Set I: 74% of the shaft length
Set II: 76% of the shaft length
Set III: 78% of the shaft length.

21. A set of golf clubs as defined in claim 13 wherein each iron has a flat bottom and a transverse width at the midpoint of the club head as follows:
Set I: ½ inch
Set II: 5/16 inch.
Set III: ¾ inch.

22. A set of golf clubs including woods and irons each of which includes a shaft and club head, the heads of said woods each being of substantially the same size, weight and external measurements, except for club face slope, and having a club face center and center of gravity located 7 mm toward the toe of the club from said club face center with the center of percussion thereof located at the club face 40 mm (±2 mm) from the axis of the shaft, said club heads of said irons each having substantially the same size and external measurements, except for club face slope and having a club face center and center of gravity located 7 mm toward the toe of the club from the club face center, with the center of percussion thereof located at the club face 60 mm (±2 mm) from the axis passing through the center of the shaft.

23. A set of golf clubs as defined in claim 22 wherein said set includes 2, 3, 4, 5, 6, 7, 8, 9 and 10 irons with said irons defining three groups of irons respectively consisting of Set I, including the 2, 3 and 4 irons; Set II including the 5, 6 and 7 irons; and Set III including the 8, 9 and 10 irons; with the irons in each set having the same shaft length.

24. A set of golf clubs as defined in claim 22 wherein each of said woods weighs 380 grams ±10 grams and the irons in Set I weigh 415 grams ±7 grams; the irons in Set II weigh 435 grams ±7 grams; the irons in Set III weigh 450 grams ±7 grams.

25. A set of golf clubs as defined in claim 23 wherein the wood shafts each include a handle and a 30 gram weight placed in the end of the handle and the iron shaft also includes a handle and a weight placed in the end of the handles with the weights added to the iron handles being selected as follows:
Set I: 27 grams ±7 grams
Set II: 23 grams ±5 grams
Set III: 20 grams ±4 grams.

26. A set of golf clubs as defined in claim 23 wherein said woods are weighted such that the balance point of the clubs is located from the end of the club handle a distance equal to approximately 70% of the shaft length and the balance points of the irons is located from the end of the club handle at distances as follows:
Set I: 74% of the shaft length
Set II: 76% of the shaft length
Set III: 78% of the shat length.

27. A set of golf clubs as defined in claim 23 wherein each iron has a flat bottom and a transverse width at the midpoint of the club head as follows:
Set I: ½ inch
Set II: 5/16 inch
Set III: ¾ inch.

* * * * *